US008764911B2

(12) United States Patent
Lee

(10) Patent No.: US 8,764,911 B2
(45) Date of Patent: Jul. 1, 2014

(54) ULTRASONIC WAVE GENERATING APPARATUS FOR PREVENTING SCALE FROM BEING PRODUCED IN PIPE AND REMOVING THE SAME FROM THE PIPE

(76) Inventor: Won-churl Lee, Anyang (KR)

( * ) Notice: Subject to any disclaimer, the term of this patent is extended or adjusted under 35 U.S.C. 154(b) by 974 days.

(21) Appl. No.: 12/785,928

(22) Filed: May 24, 2010

(65) Prior Publication Data

US 2011/0284041 A1 Nov. 24, 2011

(51) Int. Cl.
*B08B 3/12* (2006.01)

(52) U.S. Cl.
USPC ..... 134/166 C; 134/184; 134/1; 134/902; 134/1.3; 210/222; 210/695; 210/243; 310/317; 310/334; 310/316.01; 310/319

(58) Field of Classification Search
CPC ..... B08B 3/12; B08B 9/027; B08B 7/00; B06B 1/0284; B06B 2201/71
USPC ..... 134/166 C, 18, 1, 113, 56 R, 166 R, 134/22.11; 310/324, 317, 327; 73/628, 609, 73/632, 634, 625
See application file for complete search history.

(56) References Cited

U.S. PATENT DOCUMENTS

| | | | | |
|---|---|---|---|---|
| 4,484,315 | A * | 11/1984 | Hall | 367/139 |
| 4,821,575 | A * | 4/1989 | Fujikake et al. | 73/626 |
| 4,893,361 | A * | 1/1990 | Burns | 4/668 |
| 5,419,329 | A * | 5/1995 | Smith et al. | 600/447 |
| 6,462,461 | B1 * | 10/2002 | Puskas | 310/323.01 |
| 2008/0043500 | A1 * | 2/2008 | Asano et al. | 363/56.12 |

* cited by examiner

*Primary Examiner* — Michael Barr
*Assistant Examiner* — Thomas Bucci
(74) *Attorney, Agent, or Firm* — IP Strategies

(57) ABSTRACT

An ultrasonic wave generating apparatus includes: a generator including an electric power supply, a controller that generates a control signal, a liquid crystal display indicator, and a transducer drive circuit; and transducer portions. The generator includes: the controller having an internal memory or a port to which an external memory is inserted, and formed of a microcomputer to control the generator and the transducer portions; thyristor portions that are arranged respectively in the front and rear ends of the transducer portions, in which two thyristors are connected in series in the respective thyristor portions; snubber circuit portions that are connected in parallel with the respective thyristor portions; at least one transducer that is connected with the controller and is included in the transducer portions; and choke coils that are connected with one end of the respective transducers in the transducer portions.

5 Claims, 4 Drawing Sheets

ULTRASONIC WAVE GENERATING APPARATUS FOR PREVENTING SCALE FROM BEING PRODUCED IN PIPE AND REMOVING THE SAME FROM THE PIPE

BACKGROUND OF THE INVENTION

1. Field of the Invention

The present invention relates to an ultrasonic wave generating apparatus for preventing scale from being produced in a pipe and removing the same from the pipe, and more particularly, to an ultrasonic wave generating apparatus for preventing scale from being produced in a pipe and removing the same from the pipe, which is implemented so as to be controlled by a microcomputer, to thereby increase the number of transducer channels for preventing scale from being produced in the pipe and removing the same from the pipe at an explosion-preventive area and in a general facility, and to thus heighten an economic efficiency, and which is designed to be able to be used at higher voltage and higher frequency and to be operated more stably.

2. Description of the Related Art

A conventional scale preventing apparatus will be described below.

The Korean Patent Application No. 10-2005-0052523 (whose Korean Laid-open Patent Publication No. 10-2006-132268 on Dec. 21, 2006) entitled "An ultrasonic wave generating apparatus for preventing scale form being produced and removing the scale" was filed by a Korean company (Morko Co., Ltd) on Jun. 17, 2005. The scale prevention and removal ultrasonic wave generating apparatus includes a main body having an electric power supply that supplies electric voltage necessary for generation of ultrasonic waves, a resonance unit that makes transducers connected with a facility and a device generate ultrasonic waves, based on the received electric power source, and a controller that controls an operating condition of the resonance unit, in which the transducers generates ultrasonic waves by the electric voltage and an ultrasonic signal that are applied from the main body. Here, the main body and the transducers are configured to be at a given distance from each other and to be coupled with each other by electric cable.

The electric power supply included in the main body includes: an electric switch for applying electric voltage to the main body; a fuse that interrupts electric voltage from being applied to the main body, when overload or electric leakage happens due to abnormal service voltage; a magnetic switch that is operated by the applied electric voltage, to thus drive a cooling fan that cools heat generated in the main body; a fitter that filtrates noise of the applied electric voltage; and a voltage transformation circuit portion that stably supplies the electric voltage supplied by turning the electric switch on, for both the controller and the resonance unit.

The resonance unit included in the main body includes: a resonance circuit having a diode, a polar capacitor, a resistor, a thyristor and a nonpolar capacitor, which further includes light emitting diode (LED) drive coils that are respectively installed on the output lines of the thyristor and the nonpolar capacitor, to thereby detect operating states of the transducers, and to thus enable a user to confirm whether or not the transducers operate at a normal state through light emitting diodes (LEDs).

The transducers are fixedly combined at one side of a cover, through predetermined coupling units, using flanges at a place where a magnetodistortion conversion element around which a wire is wound and a waveguide that transfers ultrasonic waves are connected.

The other side of the cover is fixedly combined with a support.

A rear-surface cover is formed on the support, to thus prevent combustible and explosive gas from infiltrating into the inside of the transducers.

The ultrasonic wave generating apparatus includes: a main body having an explosion-preventive-preventive unit that maintains a differential pressure between the inner and outer portions of the main body, using a differential pressure switch into a pressure of 100 kPa, to thereby control combustible and explosive gas to be prevented from infiltrating into the inside of the transducers, an electric power supply that supplies electric voltage necessary for generation of ultrasonic waves, and a resonance unit that makes transducers generate ultrasonic waves, based on the received electric power source, and a controller that is configured as a printed circuit board (PCB) so as to control an operating condition of the resonance unit; and transducers that generate ultrasonic waves by half-wave voltage that has been applied by the resonance unit, to thereby remove scale or foreign matters in a facility.

FIG. 1 is a cross-sectional view illustrating a transducer 10 of a conventional ultrasonic wave generating apparatus. The transducer 10 is attached by weld on a place whose surface is smoothly grinded. In the transducer 10, a wire 12 is wound around a magnetodistortion conversion element 11. If electric pulse current is supplied through the wire, the magnetodistortion conversion element 11 generates minute oscillation by a magnetic field formed around the wire 12, to thereby prevent foreign matters such as scale or slime from being produced in a facility. The electric pulse current is applied from a resonance unit of the main body. The wire 12 is made of a material that endures voltage of 1000V, and temperature of −190°□+260°, and the magnetodistortion conversion element 11 is connected to a waveguide 13 that conveys ultrasonic waves to a target object.

The magnetodistortion conversion element 11 is made of a material of nickel, iron-cobalt alloy, iron-aluminum alloy, etc. A cover 14 is formed to surround the outside of the transducer 10, in order to be suitable for an explosion-preventive structure. The magnetodistortion conversion element 11 that is connected with the waveguide 13 is fixedly combined on one side of the cover 14 through coupling units 16 such as bolts using a flange 15. The other side of the cover 14 is fixedly combined with a support 17. A rear cover 18 is formed on the support 17, to thus prevent combustible and explosive gas from infiltrating into the inside of the transducer 10. Even in the case that combustible and explosive gas infiltrates into the inside of the transducer 10 to thus cause a fire to break out, the transducer 10 is implemented adaptively to the explosion-preventive structure so that flames do not come out of the transducer 10.

The principle of the ultrasonic wave generating apparatus will be simply described below.

According as time passes, foreign matters such as a considerable amount of scale or slime is produced in pipes in the case that a lot of devices and apparatuses, especially piping facilities are installed in general equipment. An ultrasonic wave generator is used for preventing foreign matters such as scale or slime from being produced in a pipe as well as removing the same from the pipe. Here, a transducer that is connected with the ultrasonic wave generator is fixed by weld on a surface of the general equipment or the pipe that is involved with the general equipment, so that ultrasonic waves are transferred into the inside of the equipment or pipe. Accordingly, the foreign matters such as the scale or slime that has been produced in the equipment or pipe are removed or suppressed from being produced.

The ultrasonic waves that remove the foreign matters such as the scale or slime that has been produced in the equipment or pipe or suppress the same from being produced therein, represent oscillation of sound that has energy that is strong as high frequency waves that are not recognized by person's ear. The ultrasonic waves generate strong oscillation with extremely high sound. Such oscillation of sound has a strong force that shakes a material. Accordingly, if ultrasonic waves are generated below a container containing water, the energy of the ultrasonic waves is strong enough to make spray, and a medium that exists along a path of the ultrasonic waves is partially heated. In addition, since ultrasonic waves have strong tensile forces, small bubbles are generated and burst as cavitation in liquid. Accordingly, a material that receives ultrasonic waves undergoes a mechanical function or a chemical change, because of strong instantaneous pressures and explosion phenomena of several tens of atmospheres that have been generated by the cavitation. As a result, even a material that is difficult to be emulsified is minutely pulverized, to thus be made into stable emulsion.

However, the conventional ultrasonic wave generating apparatus has the following defects and shortcomings.

Firstly, in view of the circuit arrangement of the case of the conventional ultrasonic wave generating apparatus, it is difficult to increase the number of transducer channels additionally. Thus, the conventional ultrasonic wave generating apparatus has a shortcoming that it is difficult to configure a system in an economic efficiency adaptively to an installation place or model.

Secondly, since the conventional ultrasonic wave generating apparatus may be cracked or broken at the portions of the coupling units of the waveguide, it has a problem that the number of after-services is enlarged or there are many returns frequently due to operational stop.

Thirdly, in the case of the conventional ultrasonic wave generating apparatus, there is a need to protect a thyristor from transient voltage that occurs by circuit inductance in the ultrasonic wave generating apparatus. In addition, light emitting diode lamps that instruct operating states of transducers receive electric power voltage from induced voltage of the transducers, but there is a need to newly design an electric power supply circuit so that the light emitting diode lamps directly receive electric power voltage from an electric power supply.

SUMMARY OF THE INVENTION

To overcome problems or inconveniences of the conventional art, and fulfill the necessity of the conventional art, it is an object of the present invention to provide an ultrasonic wave generating apparatus for preventing scale from being produced in a pipe and removing the same from the pipe, which is implemented so as to be controlled by a microcomputer, to thereby increase the number of transducer channels for preventing scale from being produced in the pipe and removing the same from the pipe at an explosion-preventive-preventive area and in a general facility, and to thus heighten an economic efficiency, and which is designed to be able to be used at higher voltage and higher frequency and to be operated more stably.

To accomplish the above object of the present invention, according to an aspect of the present invention, there is provided an ultrasonic wave generating apparatus for preventing scale from being produced in a pipe and removing the same from the pipe, the ultrasonic wave generating apparatus comprising:

a generator including an electric power supply, a controller that generates a control signal according to a program stored therein, a liquid crystal display (LCD) indicator, and a transducer drive circuit; and transducer portions that convert an electric signal into an ultrasonic signal, respectively, wherein the generator comprises:

the controller having an internal memory or a port to which an external memory is inserted, and formed of a microcomputer to control the generator and the transducer portions according to the program stored in the internal memory and the external memory;

thyristor portions that are arranged respectively in the respective front and rear ends of the transducer portions, in which two thyristors are connected in series in the respective thyristor portions;

snubber circuit portions that are connected in parallel with the respective thyristor portions, to thereby protect each thyristor from transient voltage that is generated by circuit inductance in the ultrasonic wave generating apparatus, and suppress a voltage rising rate when the thyristor is turned off to thus accomplish circuit stability;

at least one to at maximum nine transducers that are connected with the controller and are included in the transducer portions; and choke coils that are connected with one end of the respective transducers in the transducer portions and protect the ultrasonic wave generating apparatus from surge reverse voltage that is generated during operation of the transducers, and wherein the ultrasonic wave generating apparatus is programmed to operate according to the program stored in the controller after three seconds after electric voltage is applied to the ultrasonic wave generating apparatus, in order to secure stability of the ultrasonic wave generating apparatus.

Preferably but not necessarily, the transducer is surrounded by a main body cover (402), in which a screw thread that is formed around the circumference of an external diameter of the main body cover, and a screw thread (A) that is formed around the circumference of an internal diameter of a cap (401) are engaged with each other.

Preferably but not necessarily, the ultrasonic wave generating apparatus further comprises lamps indicating operating states of the transducer portions, wherein electric drive voltages of the lamps are supplied directly from the electric power supply.

Preferably but not necessarily, each snubber circuit portion is formed of a resistor and a capacitor, and is connected in parallel with each thyristor portion, and a pulse period, a pulse number, and a frequency can be changed by manipulation of a switch while seeing the LCD indicator, using the microcomputer and the LCD indicator.

BRIEF DESCRIPTION OF THE DRAWINGS

The above and/or other aspects of the present invention will become apparent and more readily appreciated from the following description of the exemplary embodiments, taken in conjunction with the accompanying drawings in which.

REFERENCE NUMERALS OF ESSENTIAL PARTS IN THE DRAWINGS

20: microcomputer
21: voltage transformation circuit portion
22, 27, 32: first thyristor and snubber circuit portion
23, 28, 33: second thyristor and snubber circuit portion
24-26: first to third transducers
29-31: fourth to sixth transducers
34-36: seventh to ninth transducers

DETAILED DESCRIPTION OF THE INVENTION

Hereinbelow, an ultrasonic wave generating apparatus according to an embodiment of the present invention will be described with reference to the accompanying drawings, that is, FIGS. 2 through 4.

Figure 1:
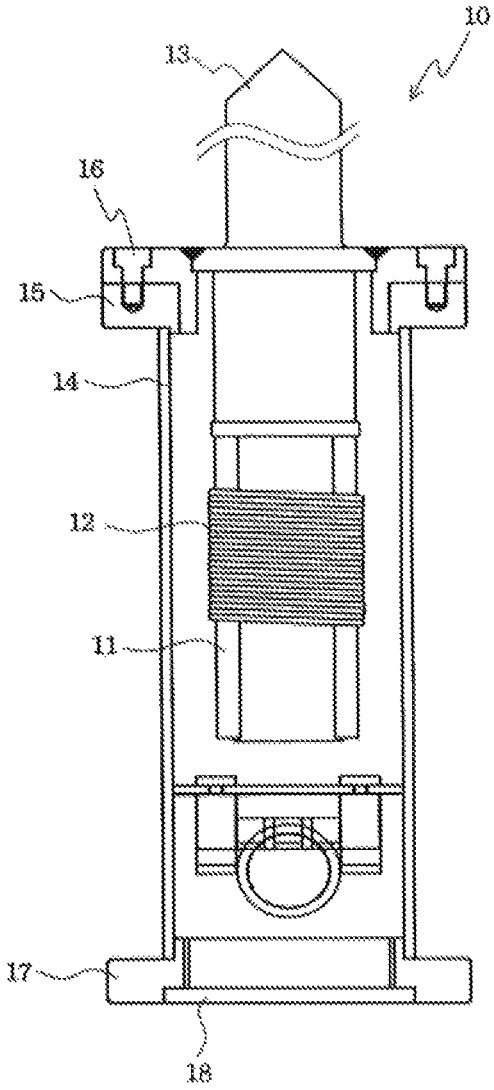
FIG. 1 is a cross-sectional view showing a conventional transducer.
Figure 2:
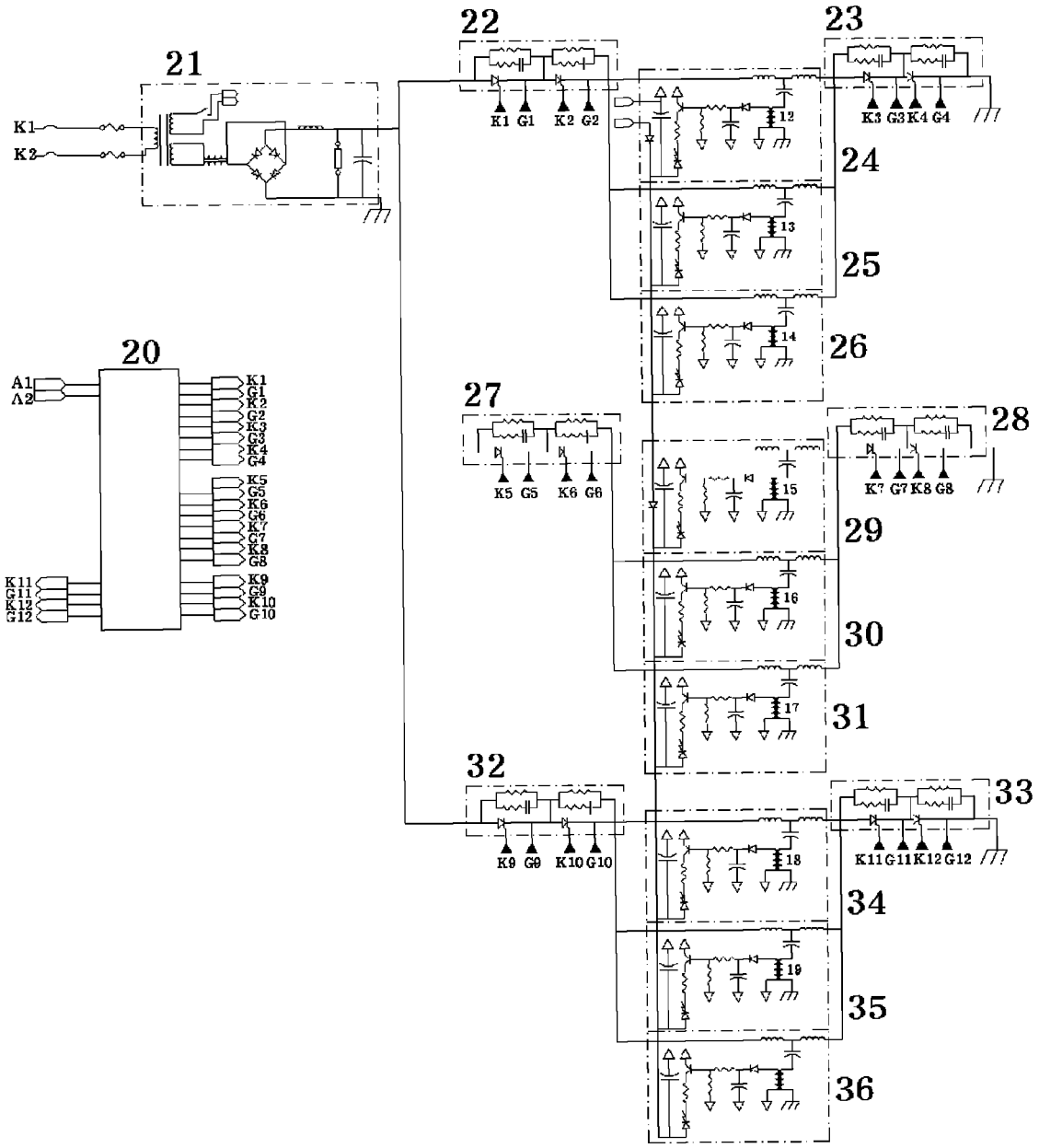
FIG. 2 is a circuit diagram that illustrates a circuit arrangement of an ultrasonic wave generating apparatus according to this invention.
Figure 3:
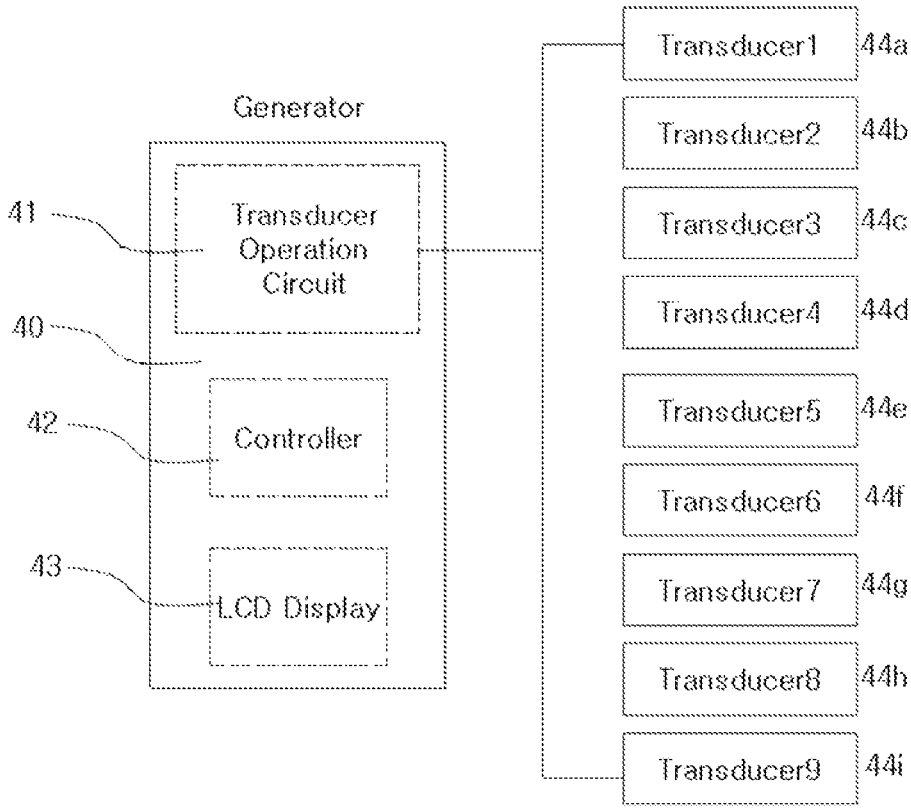
FIG. 3 is a block diagram that illustrates a configuration of an ultrasonic wave generating apparatus according to this invention.
Figure 4:
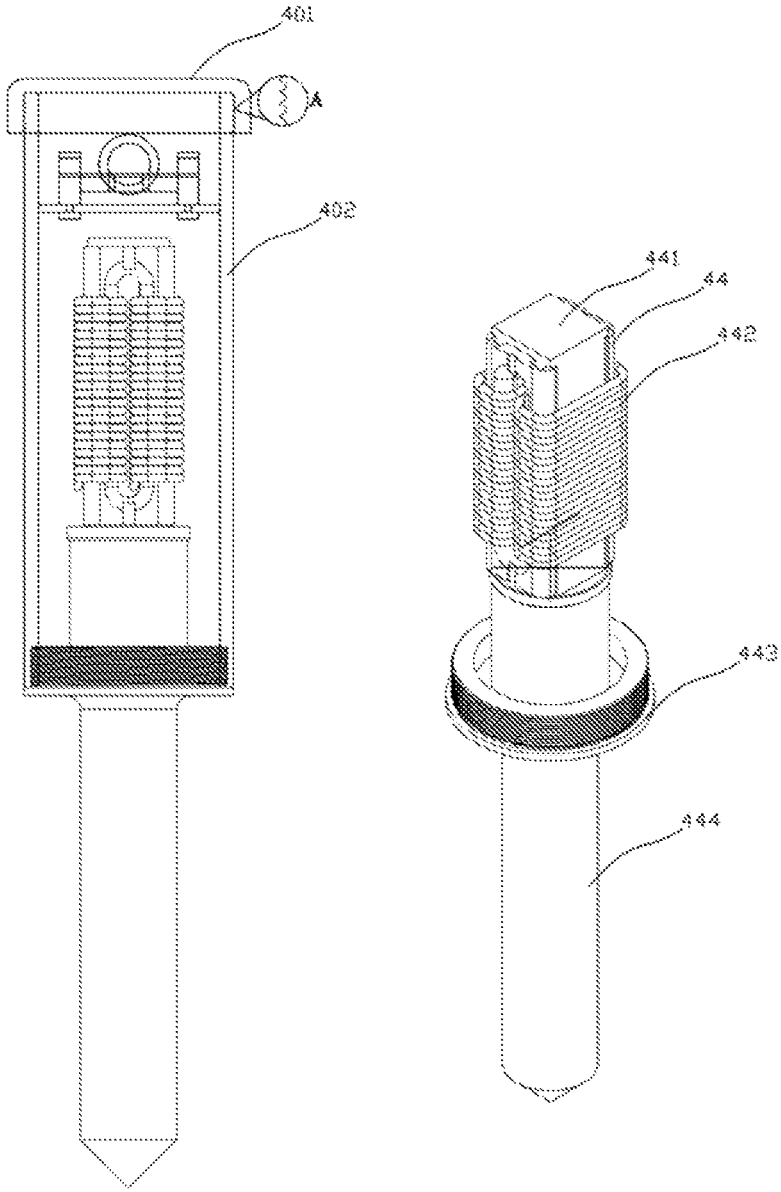
FIG. 4 is a cross-sectional view showing a transducer according to this invention.

FIG. 2 is a circuit diagram that illustrates a circuit arrangement of an ultrasonic wave generating apparatus according to this invention, and FIG. 3 is a block diagram that illustrates a configuration of an ultrasonic wave generating apparatus according to this invention.

As illustrated in FIG. 2, an ultrasonic wave generating apparatus according to this invention includes: a controller 42 that generates a control signal according to a program stored in a memory; a liquid crystal display (LCD) indicator 43 that displays a currently executing function and executable functions, based on signals received from the controller 42; a transducer drive circuit 41 that drives transducers based on signals received from the controller 42; and transducers 44*a*-44*i* that convert electric signals into ultrasonic waves of 28 kHz at maximum, under the control of the transducer drive circuit 41.

The transducer drive circuit 41 and the transducers 44*a*-44*i* will be described below in more detail.

As shown in FIG. 3, the ultrasonic wave generating apparatus includes a generator 40 having nine transducers 44*a*-44*i* and a transducer drive circuit 41.

In other words, as shown in FIG. 2, the generator 40 includes: a microcomputer 20 for controlling a plurality of transducers according to signals received from the controller 42; a voltage transformation circuit portion 21 for transforming an input voltage level and outputting the transformed result; a first transducer portion including a first transducer 24, a second transducer 25, and a third transducer 26; a first thyristor and snubber circuit 22 that is located in the front end of the first transducer portion including the first transducer 24, the second transducer 25, and the third transducer 26; and a second thyristor and snubber circuit 23 that is located in the rear end of the second transducer portion including the first transducer 24, the second transducer 25, and the third transducer 26.

Here, the first and second thyristor and snubber circuits 22 and 23 will be described below in more detail.

For example, if a thyristor is turned on too quickly in the case that rating of the thyristor is too large, forward current is concentrated on some sections of the thyristor, to thereby cause the thyristor to be locally heated. Accordingly, the thyristor may be damaged. In order to prevent this, an inductor is inserted into the thyristor and snubber circuits, respectively, to thus restrict an electric current rising rate di/dt according to change of time in order to suppress the electric current from being increased sharply when the thyristor is turned on. Meanwhile, a forward voltage rising rate dv/dt according to change of time may be restricted. This is because the thyristor may be turned on by an electrostatic capacity electric current even though a signal is not applied to a gate of a thyristor of a PNPN structure in the case that forward voltage is suddenly applied to the thyristor at a very big rate. In order to prevent this, a resistor and a capacitor are connected with both ends of the respective thyristor and snubber circuit.

Meanwhile, the ultrasonic wave generating apparatus further includes a second transducer portion having a fourth transducer 29, a fifth transducer 30, and a sixth transducer 31, a third thyristor and snubber circuit 27 that is located in the front end of the second transducer portion having the fourth transducer 29, the fifth transducer 30, and the sixth transducer 31, and a fourth thyristor and snubber circuit 28 that is located in the rear end of the second transducer portion having the fourth transducer 29, the fifth transducer 30, and the sixth transducer 31.

Meanwhile, the ultrasonic wave generating apparatus further includes a third transducer portion having a seventh transducer 34, an eighth transducer 35, and a ninth transducer 36, a fifth thyristor and snubber circuit 32 that is located in the front end of the third transducer portion having the seventh transducer 34, the eighth transducer 35, and the ninth transducer 36, and a sixth thyristor and snubber circuit 33 that is located in the rear end of the third transducer portion having the seventh transducer 34, the eighth transducer 35, and the ninth transducer 36.

The ultrasonic wave generating apparatus according to the present invention further includes lamps that represent respective operating states of the transducers. Electric drive voltages of the lamps are supplied directly from the electric power supply. As a result, when the present invention is compared with the conventional art, a shortcoming of the conventional art that brightness of the lamps is changed according to change of induced voltage in a transducer has been improved in the present invention.

The microcomputer 20 controls the first thyristor and snubber circuit 22 through connection ports K1, G1, K2, and G2, and controls the second thyristor and snubber circuit 23 through connection ports K3, G3, K4, and G4. Similarly, third through sixth thyristor and snubber circuits 27, 28, 32, and 33 are controlled through connection ports of the microcomputer 20.

The microcomputer 20 controls each of the transducers 24, 25, 26, 29, 30, 31, 34, 35, and 36 according to signals received from the controller 42 through connection ports A1 and A2, and the controller 42 is desirably a microprocessor having internal and external memories. Here, the ultrasonic wave generating apparatus is programmed to operate according to the program stored in the controller 42 after three seconds after electric voltage is applied to the ultrasonic wave generating apparatus, in order to secure stability of the ultrasonic wave generating apparatus. That is, if the ultrasonic wave generating apparatus is programmed so that the secondary portion of the ultrasonic wave generating apparatus operates according to the program stored in the controller 42 after three seconds after electric voltage is applied to the primary portion of the ultrasonic wave generating apparatus, stability of the ultrasonic wave generating apparatus can be further secured.

In addition, the transducer structure of this invention is different from that of the conventional art. As illustrated in FIG. 4, a transducer 44 includes a cobalt pack 441, a Teflon™ electric wire 442, an O ring 443, and a waveguide 444. The transducer 44 has a structure that a cylindrical cap 401 is coupled rotationally with a cylindrical main body cover 402 of this transducer 44. That is, since the transducer 44 is not coupled in a bolt and nut coupling manner, but is coupled so that a screw thread that is formed around the circumference of an external diameter of the main body cover 402, and a screw thread "A" that is formed around the circumference of an internal diameter of a cap 401 are engaged with each other, the coupling portion is prevented from being damaged.

Here, since the microcomputer and the LCD indicator are employed in the present invention, the functions that may not be possible in the conventional art can be realized, for example, a pulse period, a pulse number, and a frequency can be changed by manipulation of a switch while seeing the LCD indicator, using the microcomputer and the LCD indicator.

As described above, at least nine transducers can be implemented in a single system. Accordingly, since ultrasonic waves can be radiated to several places, a scale prevention function can be enhanced more and more. Further, a scale prevention construction area or volume can be increased according to need. In addition, since two thyristors are connected in series, handling frequency and handling voltage can be increased by more than almost two times.

Meanwhile, it is more desirable since electromagnetic interference can be suppressed and reduced if a noise filter is added at the secondary portion of the voltage transformation circuit portion 21 of FIG. 2.

As described above, according to the preferred aspect of the present invention, two thyristors are connected in series, to thereby extend life time of thyristors. Accordingly, voltage and frequency of more than two times as much as those of one thyristor can be treated, and the thyristors can be protected from transient voltage that is generated by circuit inductance in the ultrasonic wave generating apparatus, to thereby greatly extend life time of each thyristor.

Further, a choke coil is arranged in one end of a transducer, in order to prevent surge reverse voltage from being produced. At maximum nine transducers can be simultaneously implemented to thus remarkably enhance performance of a product.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

What is claimed is:

1. An ultrasonic wave generating apparatus for preventing scale from being produced in a pipe and removing the same from the pipe, the ultrasonic wave generating apparatus comprising:

a generator including an electric power supply, a controller that generates a control signal according to a program stored therein, a liquid crystal display (LCD) indicator, and a transducer drive circuit; and transducer portions that convert an electric signal into an ultrasonic signal, respectively, wherein the generator comprises:

the controller having an internal memory or a port to which an external memory is inserted, and formed of a microcomputer to control the generator and the transducer portions according to the program stored in the internal memory and the external memory;

thyristor portions that are arranged respectively in the front and rear ends of the transducer portions, in which two thyristors are connected in series in the respective thyristor portions;

snubber circuit portions that are connected in parallel with the respective thyristor portions, to thereby protect each thyristor from transient voltage that is generated by circuit inductance in the ultrasonic wave generating apparatus, and suppress a voltage rising rate when the thyristor is turned off to thus accomplish circuit stability;

at least one to at maximum nine transducers that are connected with the controller and are included in the transducer portions; and choke coils that are connected with one end of the respective transducers in the transducer portions and protects the circuit from surge reverse voltage that is generated during operation of the transducers, and wherein the ultrasonic wave generating apparatus is programmed to operate according to the program stored in the controller after three seconds after electric voltage is applied to the ultrasonic wave generating apparatus, in order to secure stability of the ultrasonic wave generating apparatus.

2. The ultrasonic wave generating apparatus according to claim 1, wherein the transducer is surrounded by a main body cover (402), in which a screw thread that is formed around the circumference of an external diameter of the main body cover, and a screw thread (A) that is formed around the circumference of an internal diameter of a cap (401) are engaged with each other.

3. The ultrasonic wave generating apparatus according to claim 1, further comprising lamps indicating operating states of the transducer portions, wherein electric drive voltages of the lamps are supplied directly from the electric power supply.

4. The ultrasonic wave generating apparatus according to claim 2, further comprising lamps indicating operating states of the transducer portions, wherein electric drive voltages of the lamps are supplied directly from the electric power supply.

5. The ultrasonic wave generating apparatus according to claim 1, wherein each snubber circuit portion is formed of a resistor and a capacitor, and is connected in parallel with each thyristor portion, and wherein a pulse period, a pulse number, and a frequency can be changed by manipulation of a switch while seeing the LCD indicator, using the microcomputer and the LCD indicator.

* * * * *